United States Patent [19]

Alikhan

[11] Patent Number: 4,543,751

[45] Date of Patent: Oct. 1, 1985

[54] COMBINED SURGICAL INSTRUMENT POLISHER AND WIPER

[76] Inventor: Raza Alikhan, 55 Bamburgh Cir., Apt. 1407, Scarborough, Ontario, Canada, M1W 3V4

[21] Appl. No.: 613,320

[22] Filed: May 23, 1984

[30] Foreign Application Priority Data

May 24, 1983 [CA] Canada ..... 428680

[51] Int. Cl.[4] ..... B24D 15/04

[52] U.S. Cl. ..... 51/181 R; 51/150; 51/358; 51/391; 51/401; 15/105; 401/195

[58] Field of Search ..... 51/4, 5 R, 150, 153, 51/156, 181, 204, 211 R, 211 H, 214, 358, 363, 391, 392, 393, 401, 402, 405, 406, 407; 15/105; 128/132 D; 401/195

[56] References Cited

U.S. PATENT DOCUMENTS

| | | | |
|---|---|---|---|
| 1,146,359 | 7/1915 | Smith | 51/401 |
| 2,727,515 | 12/1955 | Hoff | 15/209 R X |
| 2,778,044 | 1/1957 | Mikulski | 15/209 C X |
| 2,802,313 | 8/1957 | Bleam | 51/391 X |
| 2,888,785 | 6/1959 | Kellican et al. | 51/406 |
| 2,921,417 | 1/1960 | Andrews | 51/391 |
| 3,129,540 | 4/1964 | Valles | 51/401 X |
| 3,640,031 | 2/1972 | Descant | 51/391 |
| 3,738,359 | 6/1973 | Lindquist et al. | 128/132 D |
| 4,027,352 | 6/1977 | Wagner | 15/209 C |
| 4,279,103 | 7/1981 | Rodarte | 51/391 X |

FOREIGN PATENT DOCUMENTS

| | | | |
|---|---|---|---|
| 520480 | 3/1931 | Fed. Rep. of Germany | 15/105 |

*Primary Examiner*—Robert P. Olszewski
*Attorney, Agent, or Firm*—Donald E. Hewson

[57] ABSTRACT

A combined instrument polisher and wiper for use with surgical instruments is disclosed. The polisher and wiper comprises a panel of foam or sponge-like material, having a ridge which is formed in the upper surface thereof, near one end. On the upper surface, on both sides of the ridge and at both sides thereof, there is an abrasive surface; and on the lower surface of the panel of foam material, at the end thereof beneath the ridge, there is an adhesive coating for attachment of the instrument polisher and wiper to an instrument table or Mayo stand.

8 Claims, 2 Drawing Figures

COMBINED SURGICAL INSTRUMENT POLISHER AND WIPER

FIELD OF THE INVENTION

This invention relates to surgical accessories, specifically instrument polishers and wipers for use with surgical instruments; and in particular, the present invention provides a combined surgical instrument polisher and wiper.

BACKGROUND OF THE INVENTION

There are many surgical procedures where instruments that are being used in surgery may become caked or coated with blood or other body or surgical fluids. In many instances, such instruments may be required for continual use during the surgical procedure, or in any event it may be necessary to clean the instruments prior to sterilization. Examples of instruments that may be required to be cleaned or polished during surgical procedures for continuing use are cautery tips that are used for cauterizing blood vessels so as to stop bleeding, and certain kinds of clamps and forceps.

In the past, particularly during surgical procedures where it has been necessary to use cautery tips, there have been sterilized instrument wipers and sterilized cautery tip polishers provided, as separate items. That is to say, it has been the practice in the past that cautery tip polishers are provided from one source, enclosed in their own sterile pouches, and instrument wipers have been provided—very often from a different source—also in their own sterile pouches. Space on the instrument table or Mayo stand is therefore required for the cautery tip polishers and instrument wipers, and of course there are the concommitant costs of acquiring, stocking and providing separate sterilized polisher products and wiper products.

It has been the usual practice, in the past, that cautery tip polishers have been provided having a metal insert within them, for stiffening the polisher, and whereby the polisher is X-ray detectable. Instrument wipers, on the other hand, are not X-ray detectable unless they have such as a barium sulphate filament secured to them.

Moreover, some instrument polishers have, in the past, provided magnets to catch any particles of metal that may be ground off the cautery tips, but those magnets are not always effective if there is any tackiness due to the presence of drying blood or other substances; and further, they may tend to magnetize the cautery tips which effect may not be desirable in all instances, depending on the circumstances of the use of other life support systems or apparatus that may be being used or may be installed within the body of the patient.

The present invention, on the other hand, provides a combined instrument polisher and wiper that comprises an instrument polisher near one end of the device, so constructed as to be useful for cautery tips, forcep and clamp tips, bi-polar forceps, etc.; and which at the other end of the device, comprises an instrument wiper. An adhesive coating is provided on the lower surface of the combined polisher and wiper, so that it may be secured to the surface of the instrument table or Mayo stand after it has been removed from its sterilization pouch.

By providing a structure according to the present invention, the costs of additional sterilization and sterilization pouches have been substantially eliminated for all surgical procedures where it is necessary to provide both instrument polishers and wipers; and additional space on the instrument table is provided because only one surgical accessory needs to be placed on the table apart from the instrument trays and other requisite apparatus that the surgeon may have ordered to be placed for his use.

Several prior patents of interest have been noted, including HOFF U.S. Pat. No. 2,727,515, dated Dec. 20, 1955. HOFF teaches a surgical wiping pad that comprises a pad or disc of absorbent cotton, to which is secured a finger tab of one or more thicknesses of paper. The HOFF surgical wiping pad is, however, a throw-away pad which is intended primarily for use as a wiper prior to hypodermic injection, without having to touch the wiping surface.

A pad having an abrasive or scouring material at one end and a washing fabric at the other, where the scouring pad is secured to the other fabric, is shown in MIKULSKI U.S. Pat. No. 2,778,044, issued Jan. 22, 1957. That pad is, however, intended as a culinary washing pad for scouring dishes or cooking utensils, and the like.

LINDQUIST ET AL, in U.S. Pat. No. 3,738,359 issued June 12, 1973, teach a non-slip instrument pad for use by surgeons, where the instrument pad may be positioned over the body of the patient during the surgery for placing instruments thereon. Because the pad is used in close proximity to the patient, it is necessary that it must be specially treated both for purposes of sepsis and so as to reduce electrical resistivity. The pad is not otherwise used as a wiper or cleaner of any sort.

Another culinary scouring pad, in which there is a retained stiffener, is taught in WAGNER U.S. Pat. No. 4,027,352 issued June 7, 1977. That scouring pad is particularly provided for purposes of getting into the relatively sharp corners of baking pans and tins, and the like.

None of the prior art patents, nor any of the proprietary cautery tip polishers that have been provided to hospitals, satisfy the double requirement of a surgical instrument polisher and wiper that may be provided as a unitary entity from a single sterilization pouch, and which can be secured to an instrument table or Mayo stand without the necessity for providing an additional wiper.

Several commercial cautery tip cleaners are CAUTERY CADDY TM and a CAUTERY CADDY TM pad sold by Instranetics Inc., and TIPOLISHER TM sold by Devon Industries. Commercial instrument wipers include TIPWIPE TM sold by Devon Industries, and wipers sold by the Codman & Shurtleff division of Johnson & Johnson.

BRIEF DESCRIPTION OF THE DRAWINGS

The combined instrument polisher and wiper for use with surgical instruments, according to the present invention, is described in greater detail hereafter, with reference to the accompanying drawings, in which.

DESCRIPTION OF THE PREFERRED EMBODIMENT

Figure 1:
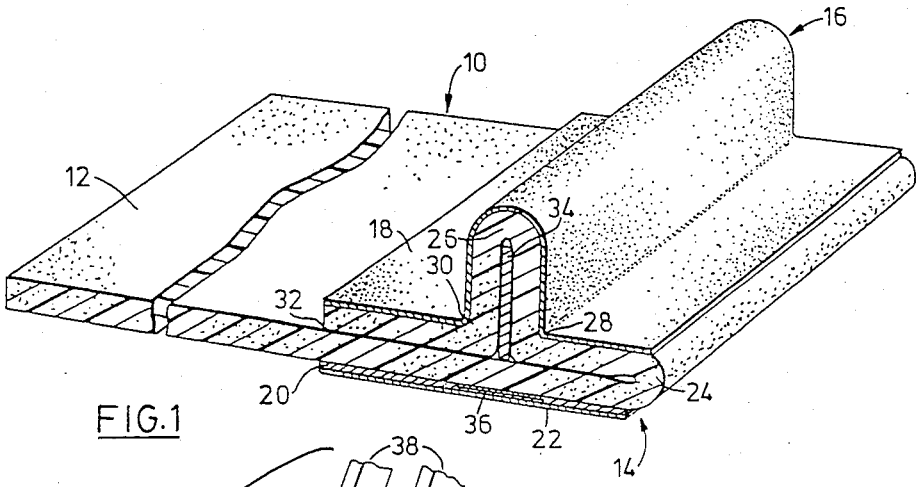
FIG. 1 is a perspective view, in cross-section, of a typical embodiment of the surgical instrument polisher and wiper of the present invention.

The following discussion is illustrative only, and is not intended to be limiting as to details of the construction of the combined surgical instrument polisher and wiper of the present invention.

As noted above, it is the purpose of the present invention to provide a combined instrument polisher and wiper that is particularly intended for use as an accessory during surgical procedures, and which finds its greatest use where it is necessary that instruments such as cautery tips must be polished during a surgical procedure so as to remove caked blood or other material from them in order that they may continue to be used. That is, it is recognized that not all surgical procedures require the use of a polisher to be maintained in the sterile field for use by the surgeon, whereas instrument wipers may be more widely used. However, when it is necessary that there be a polisher provided as well as a wiper, then it is the purpose of the present invention that both the polisher and wiper should be provided in a single structure or device, whereby it is necessary to secure only a single accessory in place on the instrument table or Mayo stand, and whereby it is necessary only to provide a single combined surgical accessory device within a single sterilization pouch. Economies of the provision of sterilization procedures and pouches, as well as the necessity to maintain a sufficient inventory of instrument wipers independently of the requisite inventory of surgical instrument polishers, is thereby achieved.

The combined surgical instrument polisher and wiper 10, that is provided by the present invention, comprises a first panel 12 of a foam or sponge-like material, such as an open-celled or a closed-celled plastic material, for example closed-cell polyethylene foam. The foam panel has some thickness—perhaps two or three mm.—and may be provided in widths of about five cm. and lengths of five to fifteen cms. Near a first end 14 of the combined instrument polisher and wiper, there is formed in the upper surface thereof a ridge 16. It is noted that the ridge 16 is not at the end 14 of the structure, but is inwards from the end to a certain extent. On the upper surface of the structure of the present invention, in the region of the ridge 16, there is an abrasive surface 18; and it is to be noted that the abrasive surface 18 is on both sides of the ridge 16 and at both sides thereof.

On the lower surface of the polisher and wiper 10, also in a region thereof near the end 14, and beneath the ridge 16, there is an adhesive coating 20, which conveniently has a removable protective film 22 over it.

The structure that is specifically illustrated in FIG. 1 suggests that the foam or sponge-like material which comprises the panel 12 is folded over at 24, so as to form the end 14, and is again folded over at 26 so as to form the ridge 16, having shoulders 28 and 30. Of course, in such a structure such as that which is specifically illustrated in FIG. 1, the facing surfaces of the foam or sponge-like material, as at 32, are securely bonded together. This structure is such that it may be machine-made, thereby creating economies of manufacture.

The abrasive surface 18 may comprise grains of a sharp abrasive material such as alumina, diamond dust, carbide dust or the like, which are securely bonded to a supporting stratum of web-like material. Indeed, very fine emory cloths or the like may be utilized.

In some instances, it may be desireable that there should be an insert 34 that is placed within the ridge 16, beneath the fold 26. That insert may be a metallic or rigid plastic insert, whereby the ridge 16 is stiffened; and when the insert is metallic—such as a strip of stainless steel having a length which is equal to the width of the panel of foam material 12—and such a strip of material is X-ray detectable, a factor which may be important in such instances where the surgeon may have elected to place the combined surgical instrument polisher and wiper of the present invention in the immediate vicinity of the surgical site. Even if it is not desireable or necessary that there be a stiffening element 34 within the ridge 16, a filament 36 of barium sulphate which is X-ray detectable; may be put in place with the adhesive coating 20, above the adhesive coating and between it and the under surface of the foam panel 12. In all events, the insert 34 is placed in the interior of the ridge 16 so as to be remote from the abrasive surface 18.

Figure 2:
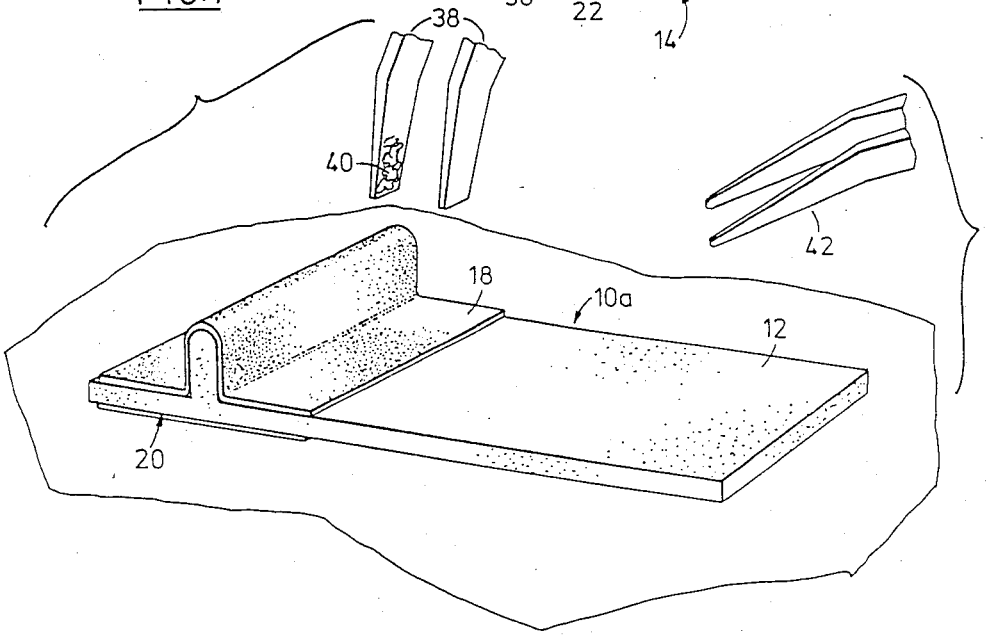
FIG. 2 is a typical view showing the surgical instrument polisher and wiper as it is used in place on an instrument table.

Referring briefly to FIG. 2, an instrument polisher or wiper **10*a* is shown as it may be placed on the surface of an instrument table or Mayo stand. So as to secure the instrument polisher and wiper 10 in place, on a drape placed on the table, the protective film 22 is been removed from the adhesive coating 20 at the one end of the lower surface thereof. A cautery tip 38, having caked blood as at 40, may be polished on the sides of the ridge 16, or in any event using the abrasive surface 18, as the surgeon may elect. Likewise, forceps 42 or other instruments may be wiped on the sponge or foam panel 12**, to clean them of blood or other substances that may be present.

The structure of the present invention precludes the necessity to provide magnets or the like, but provides a positive assurance that any metal particles that have been ground or polished off a cautery tip or other instrument by the abrasive surface 18 may be conveniently cleaned off by the material of the foam wiper panel 12.

The specific embodiment of the combined instrument polisher and wiper **10*a* as shown in FIG. 2 differs in appearance to that of FIG. 1, but all of the features thereof are found in both embodiments. Thus, an X-ray detectable element or filament is embedded in the polisher/wiper 10*a***, as is the adhesive coating on the underside and the abrasive material on the upper surface and on both sides of the ridge.

There has been described a combined instrument polisher and wiper that is particularly intended for use with surgical instruments, and one exemplary construction of that device has been specifically illustrated and discussed. Several other alternative suggestions are made as to the structure, and the advantages of the combined surgical instrument polisher and wiper, as compared with prior art devices, have been discussed. The limitations of the present invention are as defined by the appended claims.

What is claimed is:

1. A combined instrument polisher and wiper for use with surgical instruments, comprising:

a panel of sponge-like material having an upper surface and a lower surface;

a ridge formed near a first end of said polisher and wiper on said upper surface;

an abrasive surface over the upper surface of said panel in a region thereof near said first end, and on both sides of said ridge and on said upper surface at each side of said ridge;

and an adhesive coating on the lower surface of said panel in a region thereof near said first end, and at least below said ridge.

2. The surgical instrument polisher and wiper of claim 1, where at said first end of said panel, the material thereof is folded back towards the other end thereof, and said ridge is formed by a further fold of said material; and the material of said panel is securely bonded to itself in the region where it is folded back.

3. The surgical instrument polisher and wiper of claim 2, where said abrasive surface is formed by a material having an abrasive surface being securely bonded to the upper surface of said panel as formed by said folded back panel material.

4. The surgical instrument polisher and wiper of claim 1 or 2, where an insert is placed in the interior of said ridge so as to be remote from said abrasive surface, for purposes of stiffening the same.

5. The surgical instrument polisher and wiper of claim 1 or 2, having an X-ray detectable insert embedded therein.

6. The surgical instrument polisher and wiper of claim 1 or 2, further comprising a removable protective film over said adhesive coating.

7. The surgical instrument polisher and wiper of claim 1 or 2, where said abrasive surface is formed by grains of a sharp abrasive material securely bonded to a supporting stratum of web-like material.

8. The surgical instrument polisher and wiper of claim 1 or 2, where said panel of sponge-like material is formed of an open-celled or a closed-celled plastic material.

* * * * *